US010016037B2

(12) United States Patent
Broly

(10) Patent No.: US 10,016,037 B2
(45) Date of Patent: Jul. 10, 2018

(54) PROTECTIVE CASE FOR A CREDIT CARD OR SIMILAR

(71) Applicant: Fabien Broly, Colmar (FR)

(72) Inventor: Fabien Broly, Colmar (FR)

( * ) Notice: Subject to any disclaimer, the term of this patent is extended or adjusted under 35 U.S.C. 154(b) by 668 days.

(21) Appl. No.: 14/379,740

(22) PCT Filed: Feb. 22, 2013

(86) PCT No.: PCT/FR2013/050364

§ 371 (c)(1),
(2) Date: Aug. 19, 2014

(87) PCT Pub. No.: WO2013/124593

PCT Pub. Date: Aug. 29, 2013

(65) Prior Publication Data

US 2015/0041032 A1 Feb. 12, 2015

(30) Foreign Application Priority Data

Feb. 24, 2012 (FR) ..... 12 51702

(51) Int. Cl.
*A45C 11/18* (2006.01)
*A45C 13/00* (2006.01)

(52) U.S. Cl.
CPC ..... *A45C 11/182* (2013.01); *A45C 13/002* (2013.01); *A45C 2011/186* (2013.01)

(58) Field of Classification Search
CPC ..... B65D 81/3886; B65D 25/34; A61G 5/10; B62D 1/06; E04G 21/30
USPC ..... 150/149, 131, 147; 206/39.4, 37, 39.5; D9/422
See application file for complete search history.

(56) References Cited

U.S. PATENT DOCUMENTS 4,202,445 A * 5/1980 Porter ..... A45C 11/182 206/37
5,080,222 A * 1/1992 McNary ..... B65D 50/045 206/1.5
6,050,014 A * 4/2000 Ohlson ..... A45C 11/182 206/37
6,412,627 B1 * 7/2002 Tiscione ..... A45C 11/182 150/147
D465,729 S * 11/2002 Nishimura ..... D9/422
D479,462 S * 9/2003 Chan ..... D9/422
(Continued)

FOREIGN PATENT DOCUMENTS

FR 2893233 A1 5/2007
FR 2946507 A1 12/2010

*Primary Examiner* — Fenn C Mathew
*Assistant Examiner* — Cynthia Collado
(74) *Attorney, Agent, or Firm* — Andrew W. Chu; Craft Chu PLLC

(57) ABSTRACT

A protective case for a credit card has the shape of a flat envelope and forms two parallel walls between which a space is formed, intended for accommodating the card to be protected. The protective case includes at least two parts. Each part forms one of the two parallel walls, and one of the at least two parts is mounted sliding in the other, and is shaped to accommodate and hold the card. There is a housing into which a card can slide. The housing includes laterally a reversible means for holding the card, in order to secure same, and has an opening by which the card can be extracted by sliding, after sliding the part containing the card.

14 Claims, 5 Drawing Sheets

(56) References Cited

U.S. PATENT DOCUMENTS

| | | | | |
|---|---|---|---|---|
| 7,004,312 | B2 * | 2/2006 | Chen | A45C 11/18 206/232 |
| D557,053 | S * | 12/2007 | Osborn | D6/632 |
| 8,899,411 | B2 * | 12/2014 | Van Geer | A45C 11/182 206/39.4 |
| 9,339,094 | B2 * | 5/2016 | Tucker-Skow | A45C 11/182 |
| 2002/0056652 | A1 * | 5/2002 | Kawamura | A24F 15/12 206/37 |
| 2003/0057112 | A1 * | 3/2003 | Keough | A45C 11/182 206/39.4 |
| 2005/0224149 | A1 * | 10/2005 | Tiscione | A45C 11/182 150/148 |
| 2007/0109130 | A1 * | 5/2007 | Edenfield | A45C 1/06 340/572.8 |
| 2009/0101255 | A1 * | 4/2009 | Long | A45C 11/182 150/147 |
| 2013/0220842 | A1 * | 8/2013 | Lazott | A45C 11/182 206/39.4 |
| 2014/0014676 | A1 * | 1/2014 | Minson | B65D 83/0829 221/226 |
| 2014/0060712 | A1 * | 3/2014 | Beckley | A45C 1/06 150/133 |

* cited by examiner

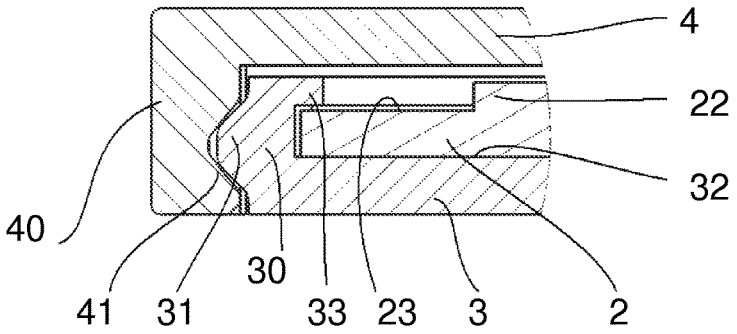
Fig. 3
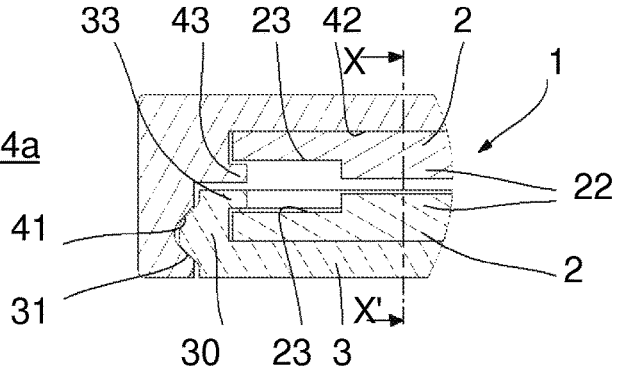
Fig. 4a
Fig. 5
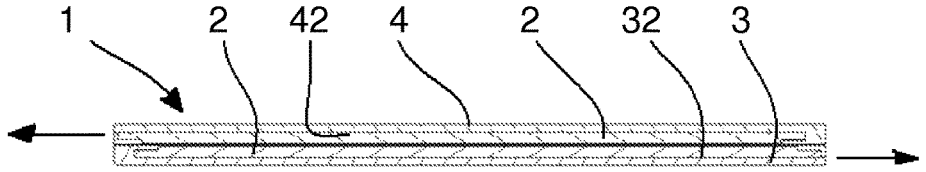
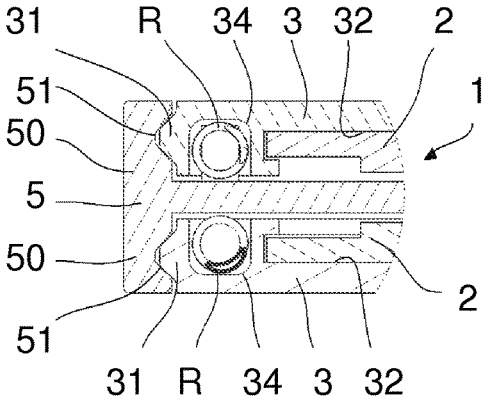
Fig. 4b
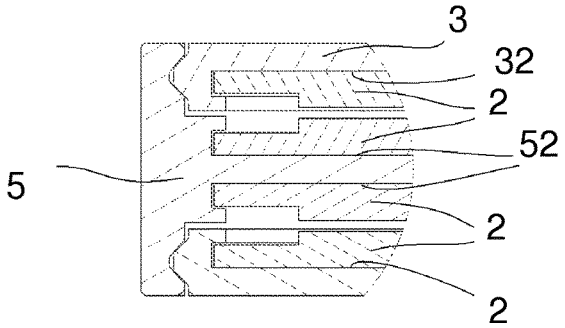
Fig. 4c

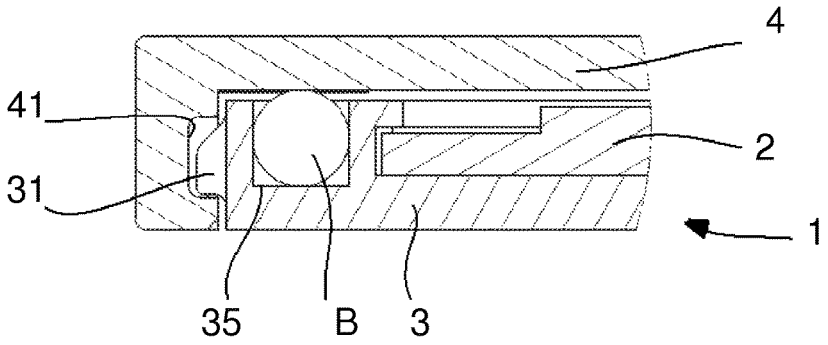
Fig. 4d
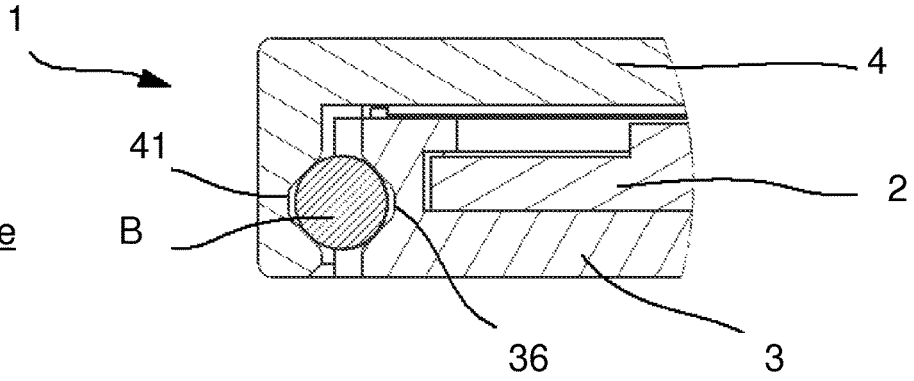
Fig. 4e
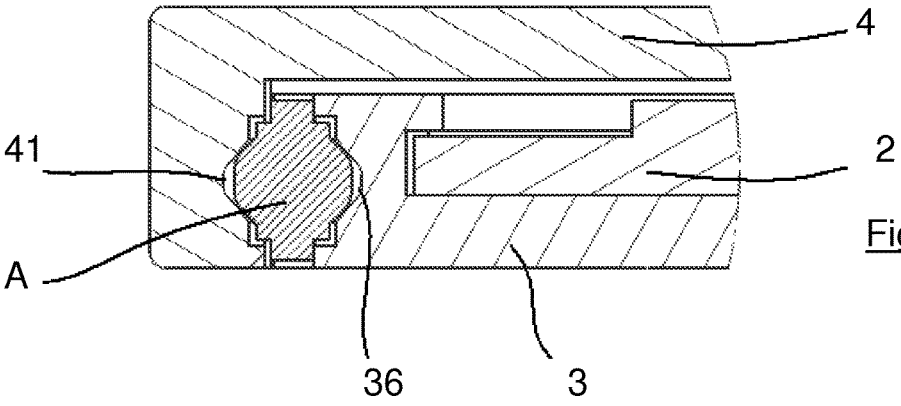
Fig. 4f
Fig. 4g
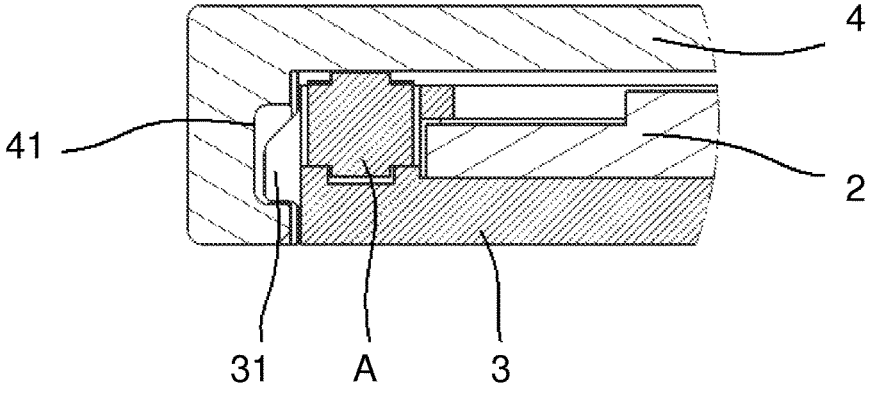

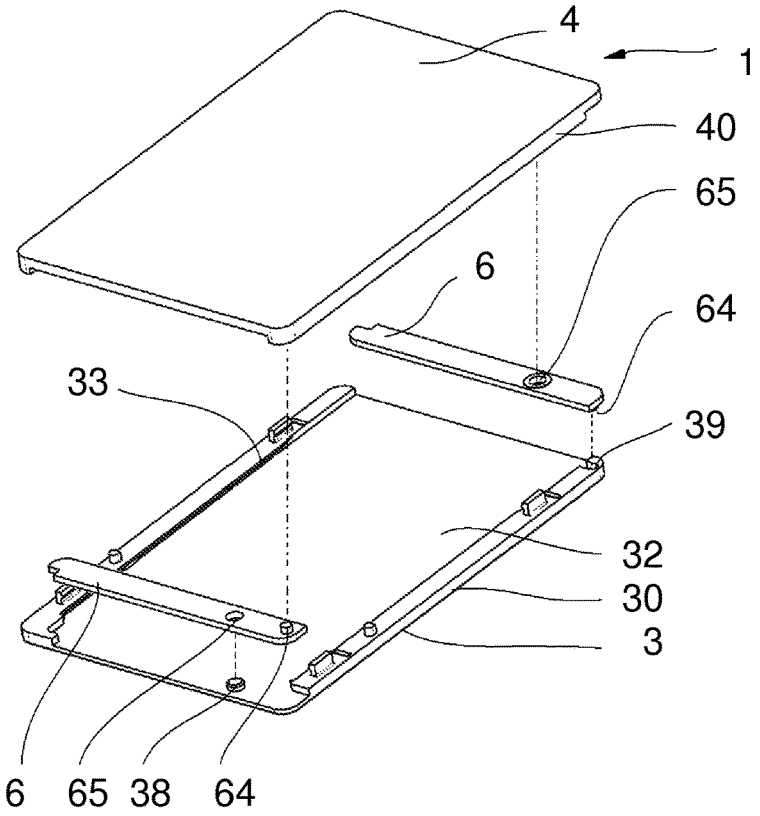
Fig. 7
Fig. 8
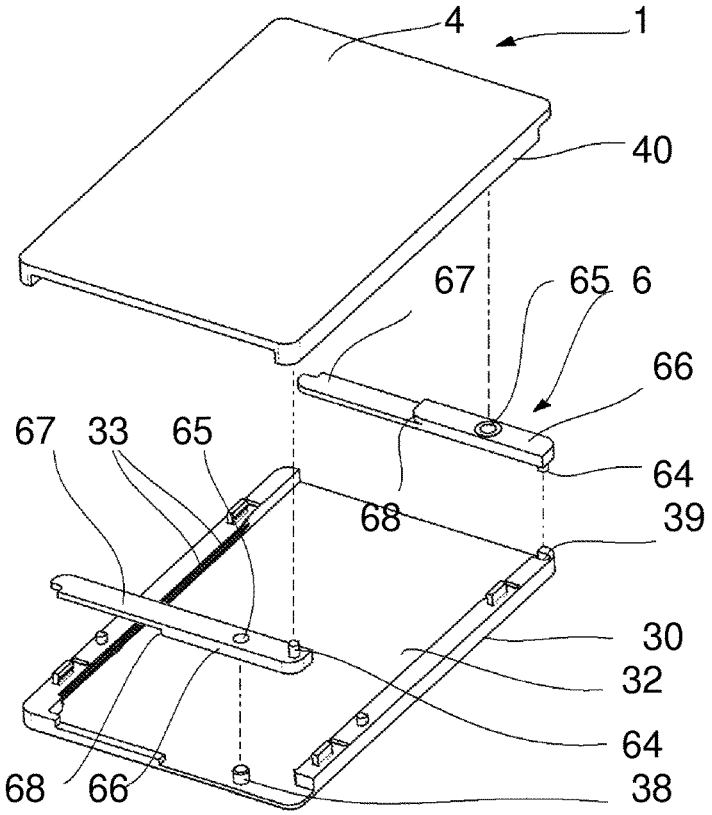

PROTECTIVE CASE FOR A CREDIT CARD OR SIMILAR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention concerns a protective case for one or more credit cards or similar.

2. Description of Related Art Including Information Disclosed Under 37 CFR 1.97 and 37 CFR 1.98.

A credit card or similar consists of a plate of a plastic material with standardised dimensions, namely 85.60×53.98 mm, with characters embossed into it, and generally including a magnetic stripe and/or a smart chip.

Due to its relative flexibility and the presence of a magnetic stripe and/or a smart chip, it is preferable to keep the card in a protected place, so that it is not damaged and remains functional.

Accordingly a credit card or similar is usually kept in a card holder or wallet, which means having to carry a card holder or wallet, which is not always possible.

To overcome this drawback, rigid protective cases have been proposed for one credit card or similar, the simplest of them consisting of a flat envelope, comprising two parallel walls between which there is provided a space intended to accommodate the card to be protected, and provided at one end with an opening through which said card can be inserted or extracted, one of said walls comprising an opening through which the user can push said card with his finger in order to extract it. Such a case is described for example in patent EP 0 677 257.

Cases are also known comprising two parts, one of which contains the card and slides inside the other like a drawer. Such a case is described for example in patent FR 2 893 233.

Whatever the case proposed, it raises the problem of the physical integrity of the card it contains. Indeed, whether the card is in a case according to patent EP 0 677 257 or in a case according to patent FR 2 893 233, it is necessary, to hold it in its housing, to exert some pressure in the direction of the thickness of the cards, and in actual fact this involves pressing on the raised elements formed by embossing, with the disadvantage that eventually this risks damaging the card. In patent FR 2 893 233 this pressure is exerted by a corrugation, in the transverse direction, in the drawer containing the card, whilst in patent EP 0 677 257, this pressure is exerted by longitudinal protuberances on the inner surfaces.

Another drawback of protective cases for a credit card or similar is that they are design to store only one card, whereas it is common to possess more than one. The above-mentioned patents do not provide for an adaptation enabling the storage of more than one card.

Cases do exist that are capable of storing several cards, and they each consist of a box with a housing in which the cards are stacked.

To overcome this drawback, cases have been proposed that may contain more than one card, as is the case for example of the cases described in patents WO 96/18320 and EP 0 287 532. These cases each consist of a box with a housing in which the cards are stacked.

In patent WO 96/18320, the case can contain two cards, which are extracted manually through an opening provided in each of the side walls of the case, in a similar way to what is described in patent EP 0 677 257.

The aim of a case being mainly to protect the cards, the fact that it includes one or more openings means that it cannot entirely fulfil its function.

In patent EP 0 287 532, a case is proposed in which several cards are stacked, and which has at the back a mobile lever, which can be operated from the outside, and whose part intended to be in contact with the cards is stepped, so that in a single movement all the cards emerge in a tiered array. Once again, the cards can be damaged as they are in contact with one another. Moreover, after a middle card is removed, it is not easy to put it back in its place, as this requires the cards on either side of its location to be prised apart.

The prior art also includes, thanks to patent US 2005/224149, a card distributor comprising a box consisting of two parts slidably assembled, on whose inner lateral edges are formed parallel lips designed to serve as sliders for the cards, which can be extracted by sliding after activating a push button. This device is more of a distributor than a case, and it is very voluminous, in particular due to the card extraction mechanism.

SUMMARY OF THE INVENTION

The aim of this invention is to propose a protective case for one or more credit cards or similar that will overcome the different disadvantages mentioned above, in particular one that is of simple design, and with no risk of damage to the cards.

The protective case for one or more credit cards or similar according to the invention has the shape of a flat envelope, comprising two parallel walls between which a space is formed, intended to accommodate the card to be protected, and provided at one end with an opening allowing the insertion or extraction of said card, and it is characterised essentially in that it comprises at least two parts each comprising one of said two parallel walls, and in that one of said at least two parts is slidably mounted on the other, and is shaped to accommodate and hold said card, and to this end comprises a housing into which a card can slide, said housing comprising on the one hand at the side a reversible means for holding said card, in order to secure same, and on the other hand having an opening by which said card can be extracted by sliding, after sliding the part containing said card.

According to an additional characteristic of the protective case according to the invention, the part slidably mounted on the other is shaped so that the card it contains cannot come into contact with the other part, and to this end the housing intended to contain said card has on the one hand the transverse dimensions allowing said card to be accommodated with a certain tolerance, and on the other hand on the two edges perpendicular to that situated on the side of said end provided with an opening, projections able to cover the edges of said card so as to hold said card in place and allow it to slide, and which are of a depth substantially greater than that of the raised elements formed by embossing on said card.

It will be understood that in the case, the card is installed in the housing, immobilised by the reversible holding means, perfectly protected, and that the only parts of the card in contact with the material the case is made of is its back which is in contact with the bottom of the housing, the two lateral edges of its front, with the inner lower surface of the projections, so that there is no risk of damage.

In practice, the user slides the two parts of the case over each other, which gives him access to the card, which he can then slide in the housing to extract it, opposing the effects of the reversible holding means.

According to an additional characteristic of the protective case according to the invention, each of the at least two parts is shaped to accommodate and hold a card so that it cannot come into contact with the other part or another card, and to this end each of said at least two parts comprises, on the side opposite the other part, a housing, open on the side of said opening, which has on the one hand the transverse dimensions allowing a card to be accommodated with a certain tolerance, and on the other hand a lateral reversible means of holding said card, in order to secure same in said housing.

In practice, when the case is designed to contain two cards, the user slides the two parts of the case over each other, which gives him access simultaneously to both cards, one on one side and one on the other side, so that he can then choose to slide out of its housing the card of his choice.

According to an additional characteristic of the protective card according to the invention, it comprises three parts, namely a middle part on which each of the two other parts, which are shaped each to contain one card, can slide.

According to an additional characteristic of the protective case according to the invention, the middle part on which the two other parts slide is shaped so that each of its sides is able to accommodate one card.

According to an additional characteristic of the protective case according to the invention, the sliding of one part in relation to the other is achieved by means of a sliding connection, one of the parts having two rails or similar, each engaged in one of two grooves in the other part.

The rails or similar may be manufactured into the parts, but they may also be added on.

According to an additional characteristic of the protective case according to the invention, the sliding of one part in relation to the other is achieved means of by a sliding connection, one of the parts having two grooves, each arranged opposite one of the two grooves in the other part, whilst intermediate connecting parts, such as balls or rollers, are engaged between said two parts, in two grooves facing each other.

It will be noted that it is possible to combine the two aforementioned sliding connections, namely a rail and groove arrangement combined with a sliding connection with balls or rollers, the latter then serving essentially to maintain the gap between the two parts, in order to protect the card.

According to an additional characteristic of the protective case according to the invention, one of the two parts has at the sides ridges intended to be slotted, with the possibility of longitudinal sliding, into grooves in the other part, each of said grooves being crossed transversely by a pin or similar, able to be engaged in a longitudinal oblong opening in the ridge.

According to an additional characteristic of the protective case according to the invention, it comprises means for indexing the different positions of one part in relation to another.

These indexing means may consist in magnetic devices.

According to an additional characteristic of the protective case according to the invention, it comprises means for assisting the sliding of one part in relation to another part.

Such assistance means may consist in springs arranged to facilitate the sliding either in the direction of opening, combined with reversible means of blocking in the closed position, necessary to avoid accidental opening, or in the direction of closing.

According to an additional characteristic of the protective case according to the invention, it comprises mobile means of ejecting the card, whose mobility is interlocked with the sliding of one part in relation to another.

According to an additional characteristic of the protective case according to the invention, the housing for a card comprises on the side opposite that dedicated to the extraction of the card, a lever against which said card rests, pivotably mounted on the part comprising said housing, and able to be pivotably driven by another part during sliding.

The protective case according to the invention may be made of different materials, both plastic and metal. It has nevertheless been designed above all to be made of metal, which enables it to be very slim, even when it is designed to hold several cards.

It will be noted that, when it is made of metal, the case according to the invention is preferably equipped with different damping means or pads to reduce the noise of metal sliding against metal.

According to an additional characteristic of the protective case according to the invention, the two parallel walls between which the space intended to accommodate the card to be protected is formed, are lined with and/or made of a material forming on each of said walls a barrier able to prevent the passage of waves.

According to an additional characteristic of the protective case according to the invention, it comprises contact means liable to be rendered inactive, enabling the two barriers to be connected.

The advantages and characteristics of the protective case according to the invention, will appear more clearly in the description that follows and which refers to the attached drawings, which show several non-limitative embodiments.

BRIEF DESCRIPTION OF THE DRAWINGS

FIG. 3 represents a partial sectional view of the same protective case according to the invention.

FIGS. 4*a*, 4*b*, 4*c*, 4*d*, 4*e*, 4*f*, 4*g*, 4*h* and 4*i* each represent a partial sectional view of a protective case according to the invention, in alternative constructions.

FIG. 5 represents a sectional view along axis XX' in FIG. 4*a*.

FIG. 7 represents an exploded schematic perspective view of a variation on the same particular embodiment of the protective case according to the invention.

FIG. 8 represents an exploded schematic perspective view of another variation on the same particular embodiment of the protective case according to the invention.

DETAILED DESCRIPTION OF THE DRAWINGS

Figures 1, 2:
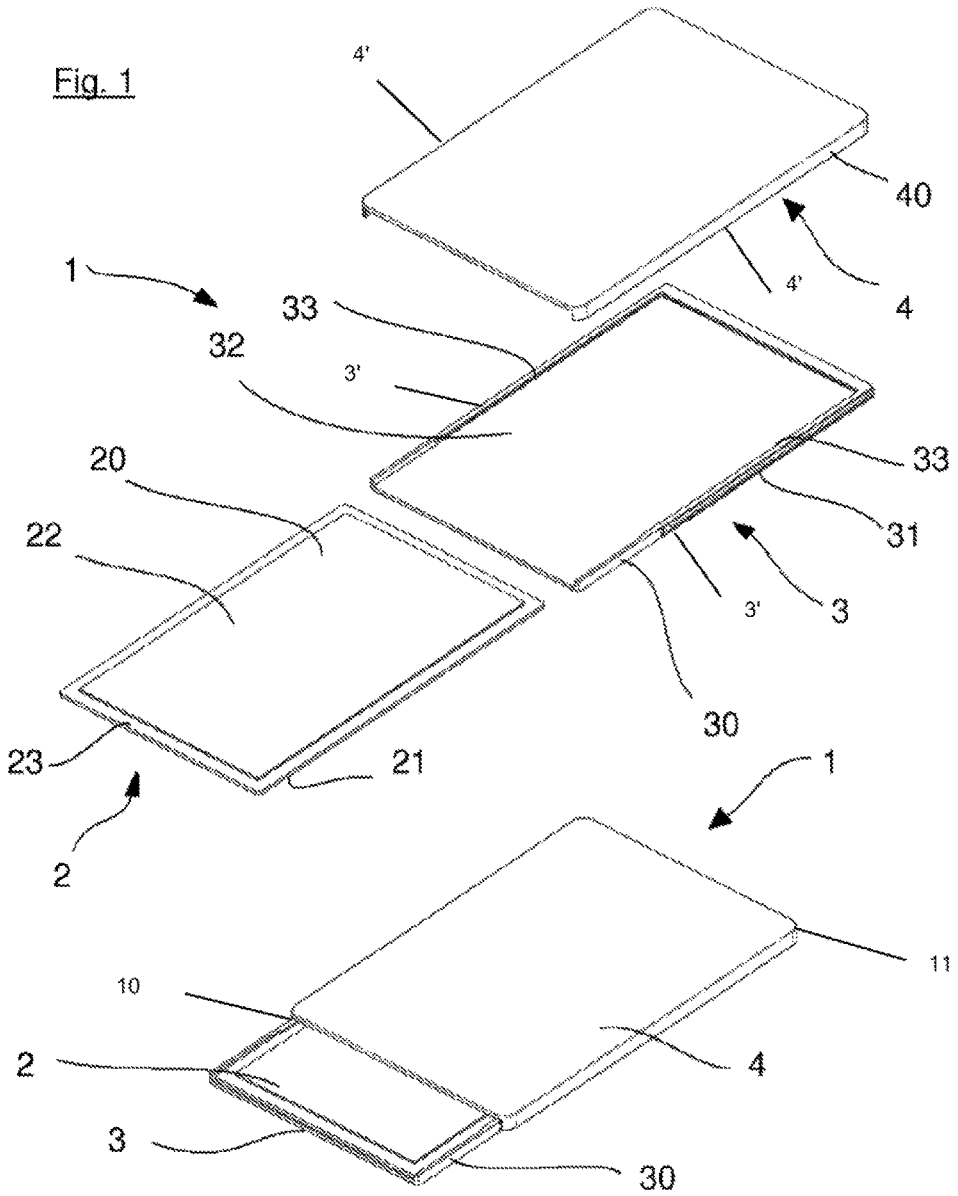
FIG. 1 represents an exploded schematic perspective view of a protective case according to the invention.
FIG. 2 represents a schematic perspective view of the same protective case.

FIGS. 1 and 2 show a protective case 1 according to the invention, designed to contain a credit card or similar 2.

It will be noted that the credit card 2 comprises a front 20 and a back 21, and that the characters embossed and visible on the front 20 are represented schematically in the form of an extra thickness 22 creating a peripheral rim 23.

The case 1 has an opening 10 on one side, and a back 11 at the opposite side. It consists of two parts 3 and 4 together, generally flat in shape, and designed to be able to slidably cooperate one with the other.

Thus, part 3 comprises on three sides a lip 30, also visible on FIG. 3, of which the two opposing segments 3' are each provided on the outside with a rail 31, whilst part 4 comprises on three sides a lip 40, whose two opposing segments 4' are each provided, on the inside, with a groove 41, with which one of the rails 31 is intended to cooperate.

The lip 30 defines a housing 32 intended to accommodate the card 2 whilst enabling it to be extracted via the fourth side which does not have a lip 30. Furthermore, the two opposing segments of the lip 30 are provided, on the inside of same, with projections 33 that extend over the edges 23 of the card 2.

Referring more precisely to FIG. 3, it can be seen that the lip 30 is of a height preferably slightly greater than the thickness of the card 2, that the projection 33 is of a depth greater than the depth of the embossing 22, and of a width smaller than the width of the rim 23.

In practice, the user first of all slides part 3 into part 4, which allows him to access the card 2, which he can then slide out of part 3.

Due to the dimensional characteristics of part 3, the card 2, and more particularly the embossing 22 on same, is never in contact with part 4, which helps to protect it.

Advantageously, in order to avoid the card 2 accidentally sliding out of part 32, lateral immobilisation means are provided, consisting for example in one or more bosses arranged on the inner surface of the lips 30, under the projections, enabling the card 2 to be sufficiently blocked, but reversibly. Depending on the method of manufacturing the case, and the material of which it is made, said immobilisation means may be moulded in or be added-on parts.

It will be noted that in the same way means are provided that prevent the accidental sliding of part 3 in relation to part 4.

Referring now to FIG. 4*a*, this figure shows an alternative version of the protective case according to the invention, and more particularly one that enables two cards 2 to be stored, whilst comprising only two parts.

To this end, part 3 is identical to that in FIGS. 1, 2 and 3, but the lip 40 on part 4 is configured so as to create, next to the housing 32, a housing 42 to accommodate a second card 2, which has the same dimensional characteristics as housing 32, namely that it is of a depth slightly greater than the thickness of the card 2, and that it has projections 43 around the edges of a depth greater than the depth of the embossing 22.

It can be seen that the two cards 2 cannot come into contact with each other and that there is therefore no risk of damaging the cards 2.

As can also be understood from FIG. 5, the opening enabling the extraction of the card 2 contained in part 4, is on the side of the case 1 opposite the side with the opening enabling the extraction of the card 2 contained in part 3. Thus, when the two parts 3 and 4 are slid one over the other, the two cards are simultaneously rendered accessible.

It will be noted that the figures only show the sliding of a card in the longitudinal direction of same, but of course it is possible to design cases where sliding takes place in the other direction.

Referring now to FIG. 4*b*, this figure shows another alternative version, also capable of storing two cards 2.

In this version, the case comprises three parts, namely a middle part 5 and two parts 3, as described above. The middle part 5 takes the form of two parts 4 assembled back to back, that is to say that it comprises on each of its surfaces, on three sides a lip 50, whose two opposing segments are each provided, on the inside with a groove 51, with which one of the rails 31 of part 3 is designed to cooperate.

In this alternative embodiment, the parts 3 may slide, in relation to the middle part 5, in the same direction or in opposite directions. It may even be imagined that the parts 3 may slide in two different directions, namely perpendicular to each other.

It will be noted that it is possible to provide a means of assisting the sliding. This FIG. 4*b* therefore shows the presence of springs R enclosed in a housing 34 in the lip 30, which can assist the sliding, such assistance being able to be provided, as needed, on opening, but preferably on closing.

It will also be noted that it is possible to provide a means of assisting the sliding, using a spring, on a case of the type shown in FIGS. 4*a* and 5, and comprising only two parts. In this case, the spring or springs operate as return spring(s) upon closing, whilst parts 3 and 4 each have a stop member designed to cooperate with the card contained in the housings 42 and 32 respectively, so that, upon sliding, these stops slide over the cards to place themselves behind same, and that upon closing, under the effect of the spring or springs, they cause the extraction of said cards.

Referring now to FIG. 4*c*, this figure shows an alternative version capable of storing four cards 2. This is in fact a double version of the case represented in FIG. 4*a*, where a middle part 5 also comprises two housings 52.

Referring now to FIGS. 4*d* and 4*g*, these figures show a case 1 capable of storing only one card 2, where part 3 comprises, parallel to the rail 31, a recess 35 containing balls B in FIG. 4*d* and rollers A in FIG. 4*g*, able to roll against part 4 with a view to facilitating the sliding.

Referring now to FIGS. 4*e* and 4*f*, these figures show a case 1 capable of storing only one card 2, where the rail is replaced by a groove 36, whilst the connection with the groove 41 on part 4 is achieved using a ball B in FIG. 4*e*, and by rollers A in FIG. 4*f*.

Figure 4H:
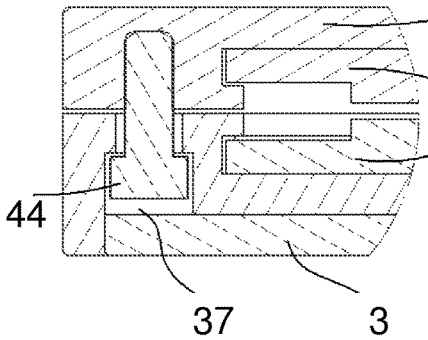
Figure 4I:
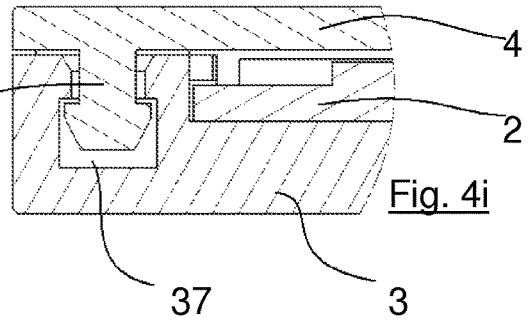

Referring now to FIGS. 4*h* and 4*i*, these figures show variations concerning the system for sliding part 3 over part 4. Thus, part 3 comprises, facing part 4, longitudinal orifices 37 parallel to the direction of sliding, in each of which is engaged a peg 44 integral with part 4.

In the version shown in FIG. 4*h*, the pegs 44 are connected with part 4 after putting part 3 in place 3, by passing through the orifices 37, whilst in the version shown in FIG. 4*i*, the pegs 44 are manufactured as integral with part 4 and are engaged by force in the orifices 37.

Figure 4J:
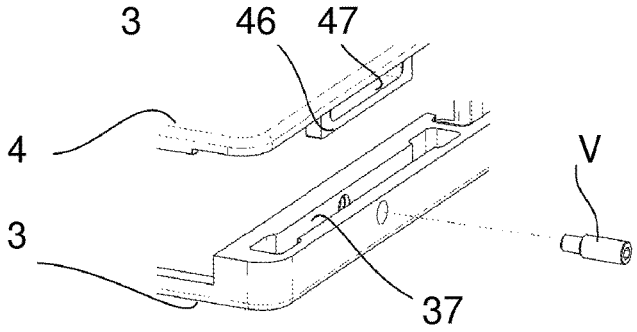
FIG. 4*j* represents a partial exploded schematic perspective view of another alternative construction.

Referring to FIG. 4*j*, this figure shows another alternative construction, where part 4 comprises on the periphery, at the sides, longitudinal ridges 46, which protrude to slot into orifices or grooves 37 in part 3, and in which they can move in a limited way during sliding, each ridge 46 comprising an oblong opening 47 in which is engaged a pin or similar, preferably a screw V, which crosses the groove 37.

It will be noted that advantageously, the ends of the grooves 37 may be provided with stops, not shown, for the purpose of damping the movements and limiting the operating noise.

Generally, it will be noted that it is possible that the two parts 3 and 4 may be of identical design, but asymmetrical, that is to say that they comprise both male and female assembly parts, so that they can be assembled together after turning one of them round.

Figure 6:
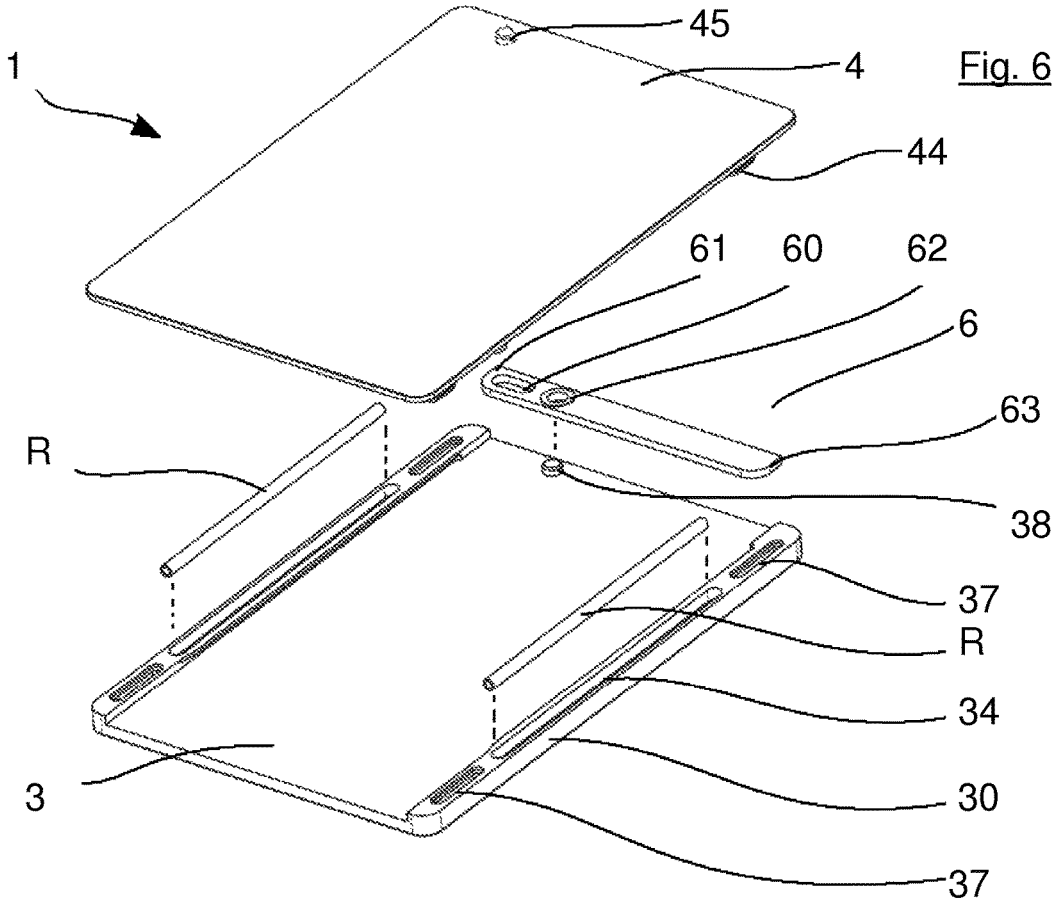
FIG. 6 represents an exploded schematic perspective view of a particular embodiment of the same protective case according to the invention.

Referring now to FIG. 6, this figure shows a particular embodiment of the case 1 according to the invention.

In this embodiment, where the assembly is analogous to that shown in FIG. 4*i*, the lip 30 of part 3 only extends on two opposing sides, the third, which constitutes the back of the case 1, being replaced by a lever 6 pivotably mounted on a stud 45, which protrudes from the inner surface of part 4, and which is represented by a dotted line in the figure, engaged in a hole 60, oblong in shape, in the lever 6 at one end 61 of same. The lever 6 comprises, close to the hole 60, a second hole 62 into which slots a stud 38, integral with part 3.

It will be understood that the sliding movement of part 4 over part 3, causes the pivoting of the lever 6, whose free end 63 propels the card 2, not shown, out of the case 1, the oblong shape of the hole 60 enabling the compensation of the movement of the stud 38 non-concentrically to the axis of the stud 45. The amplitude of the movement of the card 2 depends on the amplitude of movement of the free end 63 of the lever 6, which movement depends on the amplitude of movement of part 4 in relation to part 3 and on the distance separating the two holes 60 and 62.

Due to the demultiplication obtained, a small amplitude of movement of part 4 in relation to part 3 is enough to push the card 2 far enough out.

The presence of the springs R enables, after extraction of the card 2, the parts 3 and 4 to return to their initial position.

It will be noted that a variation of this embodiment, adapted to two cards 2 can be achieved perfectly by symmetry, part 3 then becoming a middle part on which two parts 4 slide.

It will also be noted that in the case of such an alternative, it is possible that the two parts 4 may slide in perpendicular directions.

Referring now to FIG. 7, this figure shows an alternative version where the case 1 allows the storage of two cards 2, with a system of extracting the cards 2, whilst consisting only of two parts 3 and 4.

The parts 3 and 4, which are slidably mounted one upon the other, and provided with return springs, not shown, each comprising a housing 32 and 42, the latter not being visible in the figure, a lever 6 provided at one end with a pivot 64 and close to it a hole 65.

The lever 6 intended to extract the card contained in the housing 32 of part 3, is mounted, through the hole 65, on a stud 38 protruding from part 3, whilst its pivot 64 is slotted into a hole, not visible, in the lip 40 of part 4.

Likewise, the lever 6 intended to extract the card contained in the housing 42 of part 4, is mounted, through the hole 65, on a stud, not visible, protruding from part 4, whilst its pivot 64 is slotted into a hole 39 in the lip 30 of part 3.

The levers 6 are of course of a thickness limited to that of a card, and are only mobile within the space occupied by the card with which they are associated in the housing 32 or 42.

During the sliding of parts 3 and 4 in relation to each other, part 4 pivots, by means of its stud, not visible, engaged in the hole 65 of the lever 6, the latter on part 3 by means of pivot 64 engaged in hole 39, resulting in the extraction of the card contained in the housing 42, not visible.

Simultaneously, part 3 pivots, by means of its stud 38, engaged in the hole 65 in the second lever 6, the latter on part 4 by means of the pivot 64 engaged in the hole, not visible, in the lip 40, resulting in the extraction of the card contained in the housing 32.

As for the embodiment shown in FIG. 6, the distance separating the pivot 64 from the hole 65, determines the degree of demultiplication of the extraction of the cards.

Referring now to FIG. 8, this figure shows an alternative version able to store up to 4 cards. Each of the parts 3 and 4 comprises a double housing, enabling two cards to slide independently of each other and parallel to each other through projections 33 and 43, not visible, whilst the levers 6 are configured to have a proximal part 66 of a thickness corresponding to that of the double housing, and a distal part 67 of half that thickness, which creates at the junction of the two parts, proximal 66 and distal 67, a shoulder 68.

It will be understood that during the sliding of the parts 3 and 4 in relation to each other, each of the levers 6 propels two cards, one by means of the distal part 67, and the other by means of the shoulder 68, so that the cards are extracted offset.

Generally, whatever the embodiment considered, it is possible to index the different positions of part 3 in relation to part 4, by means for example of magnets placed on the two parts 3 and 4 in positions and with orientations facilitating the desired action.

It is thus possible to provide that the magnets attract each other in extreme positions of the parts 3 and 4 in relation to each other, in order to mark these positions, and that they repel each other in intermediate positions to facilitate the sliding.

Also generally, it is possible to provide a flap closing the case, pivotably and/or slidably mounted, able to retract when the parts 3 and 4 slide over each other upon opening.

In all the embodiments shown, the case 1 is able to store one or more credit cards or similar, with no risk of damage.

The protective case according to the invention physically protects the card or cards it contains, but also, depending on the embodiment, from remote reading of the information on it/them.

Indeed, the use of contactless credit cards is growing fast, and with this comes an increased risk of fraud, such as the remote reading of the card holder's bank details.

Advantageously, the case can be made partly or entirely from a material able to constitute an electromagnetic barrier capable of preventing the passage of waves.

The outer walls can thus be made of metal, or coated in metal, and preferably contact means can connect said metal parts to each other to form a cage.

It will be noted that advantageously, the above-mentioned contact means are designed to be active when the case is closed, and inactive when the case is open, so as to enable the use of the card's contactless function without having to take it out of the case, but simply by opening the case.

The invention claimed is:

1. A protective case for a credit card, the case comprising:

a first part being comprised of a first lip around three sides of said first part, said three sides of said first part having two first opposing segments on opposing sides of said first part;

a second part being comprised of second lip around three sides of said second part, said three sides of said second part having two second opposing segments on opposing sides of said second part, wherein said first part and said second part are in sliding engagement so as to form two parallel walls, an opening at one end of the walls, and a housing between the walls in a first configuration and separated parallel walls, and a space between the walls in a second configuration;

a reversible means for holding a card in said housing of said first configuration and releasing said card from said space of said second configuration; and means for assisting sliding between said first configuration and said second configuration, said means for assisting being comprised of springs between said two opposing segments of said first part and said two opposing segments of said second part.

2. The protective case, according to claim 1, wherein said second part is separate from said card in said first configuration, said housing having transverse dimensions so as to allow said card to be accommodated within said housing, wherein said first part comprises projections on said two opposing segments of said first part so as to cover edges of said card, and wherein said card is comprised of embossing, said edges having a thickness greater than a thickness of said embossing.

3. The protective case, according to claim 2, wherein said reversible means for holding a card is comprised of a reversible means for holding a card and another card in said first configuration, said second part and said another card being separate from said card in said first configuration, said first part and said card being separate from said another card in said first configuration, said housing having transverse dimensions so as to allow said card and said another card to be accommodated within said housing, wherein said first part comprises projections on said two opposing segments of said first part so as to cover edges of said card, wherein said second part comprises projections on said two opposing segments of said second part so as to cover edges of said another card, wherein said card is comprised of embossing, said edges having a thickness greater than a thickness of said embossing of said card, and wherein said another card is comprised of embossing, said edges of said another card having a thickness greater than a thickness of said embossing of said another card.

4. The protective case, according to claim 3, wherein said second part is comprised of a middle part, the case further comprising:

a third part being comprised of a third lip around three sides of said third part, said three sides of said third part having two third opposing segments on opposing sides of said third part.

5. The protective case, according to claim 4, wherein said third part and said second part are in sliding engagement so as to form additional two parallel walls, an additional opening at one end of the additional two parallel walls, and an additional housing between the additional two parallel walls in an additional first configuration and an additional separated parallel walls, and an additional space between the additional two parallel walls in an additional second configuration, and wherein said first part is moveable between said first configuration and said second configuration relative to said middle part of said second part independent from said third part being moveable between said additional first configuration and said additional second configuration relative to said middle part of said second part.

6. The protective case, according to claim 1, wherein said first part comprises two rails, each rail corresponding to said two opposing segments of said first part, wherein said second part comprises two grooves, each groove corresponding to said two opposing segments of said second part, and wherein said first part and said second part are in sliding engagement according to each rail in cooperation with each respective groove.

7. The protective case, according to claim 1, wherein said first part comprises two first grooves, each first groove corresponding to said two opposing segments of said first part, wherein said second part comprises two second groove, each second groove corresponding to said two opposing segments of said second part, the case further comprising:

intermediate connecting parts between said two first grooves and each corresponding second groove, wherein said first part and said second part are in sliding engagement according to each first groove, each intermediate connecting part, and each second groove.

8. The protective case, according to claim 7, wherein said intermediate connecting parts are selected from a group consisting of: a plurality of pins and a plurality of pegs, wherein said pins are fixed attached to said second grooves with ends in sliding engagement with said first grooves, and wherein said pegs are made integral with said second grooves with heads in sliding engagement with said first grooves.

9. The protective case, according to claim 1, further comprising mobile means of ejecting the card from said first configuration to said second configuration.

10. The protective case, according to claim 9, wherein said mobile means of ejecting is comprised of a lever pivotally mounted on said first part, wherein said second part actuates said lever when moving between said first configuration and said second configuration.

11. A protective case for a credit card, the case comprising:

a first part being comprised of a first lip around three sides of said first part, said three sides of said first part having two first opposing segments on opposing sides of said first part;

a second part being comprised of second lip around three sides of said second part, said three sides of said second part having two second opposing segments on opposing sides of said second part, wherein said first part and said second part are in sliding engagement so as to form two parallel walls, an opening at one end of the walls, and a housing between the walls in a first configuration and separated parallel walls, and a space between the walls in a second configuration; and a reversible means for holding a card in said housing of said first configuration and releasing said card from said space of said second configuration, wherein the two parallel walls are comprised of a material so as to form a barrier to electromagnetic waves in said first configuration.

12. The protective case, according to claim 11, further comprising a contact means so as to remove said barrier in said second configuration.

13. A protective case for a credit card, the case comprising:

a first part being comprised of a first lip around three sides of said first part, said three sides of said first part having two first opposing segments on opposing sides of said first part;

a second part being comprised of second lip around three sides of said second part, said three sides of said second part having two second opposing segments on opposing sides of said second part, wherein said first part and said second part are in sliding engagement so as to form two parallel walls, an opening at one end of the walls, and a housing between the walls in a first configuration and separated parallel walls, and a space between the walls in a second configuration;

a reversible means for holding a card in said housing of said first configuration and releasing said card from said space of said second configuration; and means for indexing said first configuration and said second configuration.

14. The protective case, according to claim 13, wherein said means for indexing comprises magnetic devices in said first part and complementary magnetic devices in said second part.

* * * * *